US010471334B1

(12) United States Patent
Iverson

(10) Patent No.: US 10,471,334 B1
(45) Date of Patent: Nov. 12, 2019

(54) UNIVERSAL SHOE HARNESS FOR NORDIC SKI

(71) Applicant: Thomas K Iverson, Portland, OR (US)

(72) Inventor: Thomas K Iverson, Portland, OR (US)

( * ) Notice: Subject to any disclaimer, the term of this patent is extended or adjusted under 35 U.S.C. 154(b) by 0 days.

(21) Appl. No.: 16/167,231

(22) Filed: Oct. 22, 2018

(51) Int. Cl.
*A63C 9/00* (2012.01)
*A63C 9/20* (2012.01)
*A63C 9/12* (2012.01)

(52) U.S. Cl.
CPC ..... *A63C 9/20* (2013.01); *A63C 9/002* (2013.01); *A63C 9/003* (2013.01); *A63C 9/12* (2013.01)

(58) Field of Classification Search
CPC ..... A63C 9/20; A63C 9/002; A63C 9/003; A63C 9/12; A63C 9/00
See application file for complete search history.

(56) References Cited

U.S. PATENT DOCUMENTS 4,335,531 A 6/1982 Salomon
5,259,128 A * 11/1993 Howell ..... A44B 11/14 24/200
5,720,120 A 2/1998 Smith
5,823,563 A * 10/1998 Dubuque ..... A63C 9/20 280/615
6,234,514 B1 * 5/2001 Dubuque ..... A63C 9/083 280/615
6,742,286 B2 * 6/2004 Giovale ..... A43C 15/061 36/62
6,945,543 B2 9/2005 De Bortoli
6,986,526 B2 * 1/2006 Haughlin ..... A63C 9/20 280/613
7,011,334 B2 * 3/2006 Holzer ..... A63C 10/10 280/11.3
7,246,812 B1 * 7/2007 Ayliffe ..... A63C 9/20 280/615
7,458,598 B2 * 12/2008 Giffin ..... A63C 9/02 280/605
7,735,851 B2 * 6/2010 Shute ..... A63C 7/1026 280/613
7,931,292 B2 4/2011 Miralles
8,191,917 B2 * 6/2012 Wang ..... A63C 10/045 280/11.3

(Continued)

FOREIGN PATENT DOCUMENTS

EP 0156159 B1 5/1987

OTHER PUBLICATIONS

Cross-country skis and snowshoes in one—Trackers Skishoes Many options available for Trackers Skishoes Found on: Jul. 7, 2018 Found at: http://trackerskishoes.com/ourProducts.html.

(Continued)

*Primary Examiner* — Hau V Phan

(57) ABSTRACT

A ski shoe harness includes a sole, a receiver, and a heel strap. The sole includes a binding mechanism adapted to engage a binding system of a ski. The sole and the receiver are attached and define a space to receive the front portion of a shoe. The heel strap, attached to the receiver, wraps around the rear portion of the shoe, interlocking the ski shoe harness with the shoe. Further, the heel strap includes an adjustment mechanism. Using the ski shoe harness of the present invention, non-ski shoes and boots of a various designs and sizes may be used to share and utilize skis having common cross-country binding systems.

16 Claims, 4 Drawing Sheets

(56) References Cited

U.S. PATENT DOCUMENTS

| | | | | |
|---|---|---|---|---|
| 9,050,521 | B2 * | 6/2015 | Girard | A63C 9/20 |
| 9,149,711 | B1 * | 10/2015 | Kavarsky, Jr. | A63C 10/103 |
| 9,220,970 | B1 * | 12/2015 | Kavarsky, Jr. | A63C 10/103 |
| 9,242,168 | B1 * | 1/2016 | Kavarsky, Jr. | A63C 10/103 |
| 2002/0008366 | A1 * | 1/2002 | Rittmeyer | A63C 10/06 280/613 |
| 2002/0153703 | A1 * | 10/2002 | Okajima | A43B 5/0401 280/613 |
| 2008/0127523 | A1 | 6/2008 | Hauglin | |
| 2011/0057420 | A1 * | 3/2011 | Walker | A63C 9/0802 280/624 |
| 2014/0151981 | A1 * | 6/2014 | Berthet | A63C 9/00 280/611 |
| 2014/0232087 | A1 * | 8/2014 | Bulan | A63C 5/02 280/620 |

OTHER PUBLICATIONS

Bill Marchel How to . . . retrofit snowshoe bindings to cross-country skis Found on: Jul. 7, 2018 Found at: http://www.startribune.com/how-to-retrofit-snowshoe-bindings-to-cross-country-skis/235627401/.
XC Quickie Snowshoe Binding Home Page Found on: Jul. 7, 2018 Found at: http://www.dtbakerprojects.com/ets/xcquickie/index.htm.
Glidelite Universal Binding—Black Diamond Gear Found on: Oct. 19, 2018 Found at: https://www.blackdiamondequipment.com/en_US/glidelite-universal-binding-BD1301040000ALL1.html.
Black Diamond Equipment Ltd. Glidelite Universal Bindings (a user's manual).

* cited by examiner

FIG. 1A
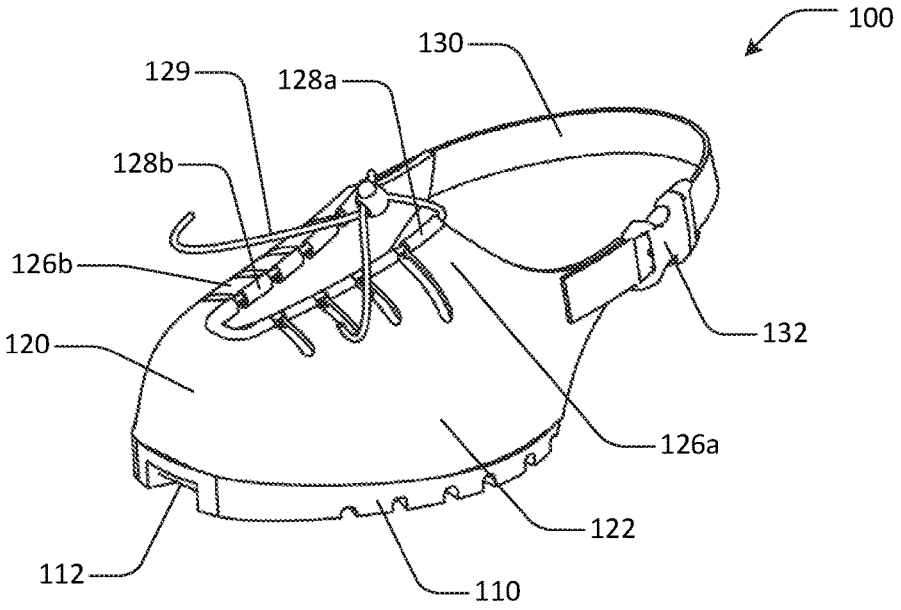
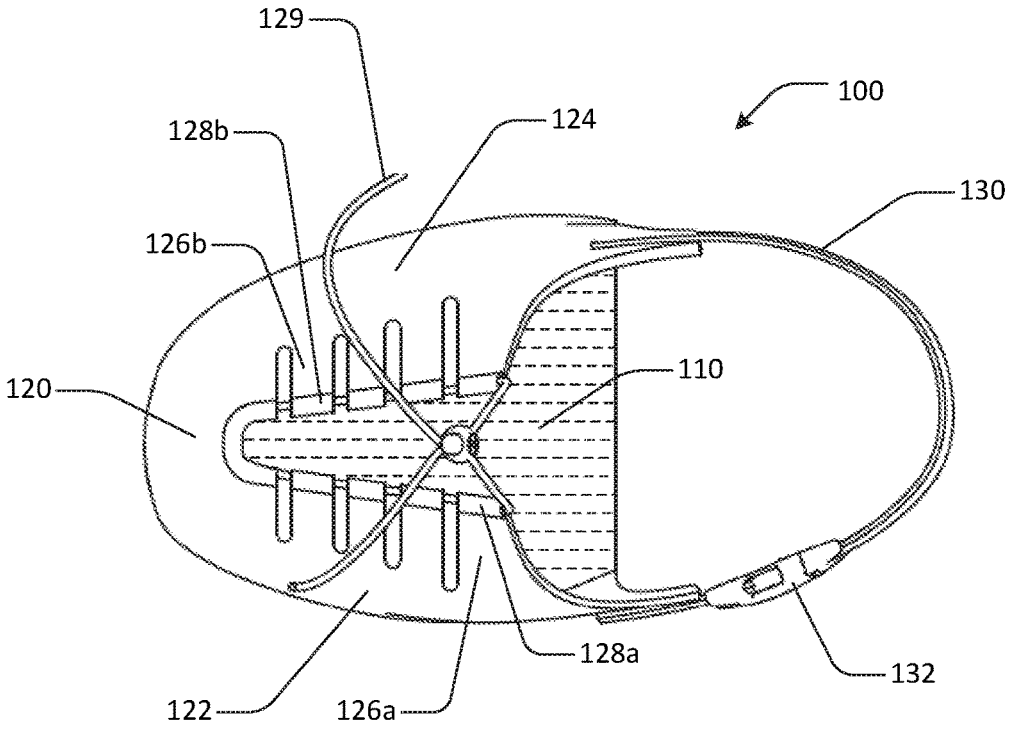
FIG. 1B

FIG. 2A
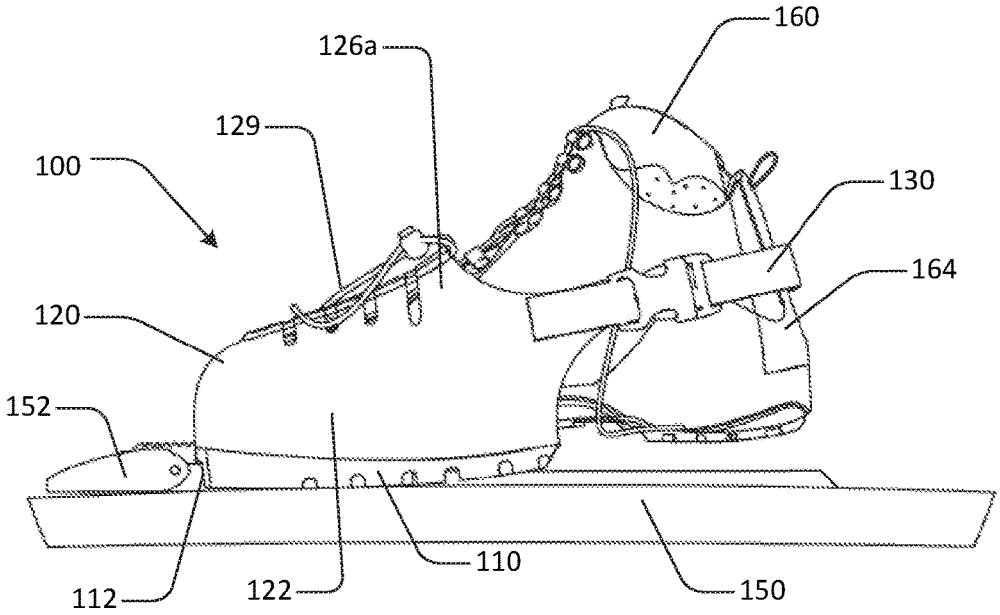
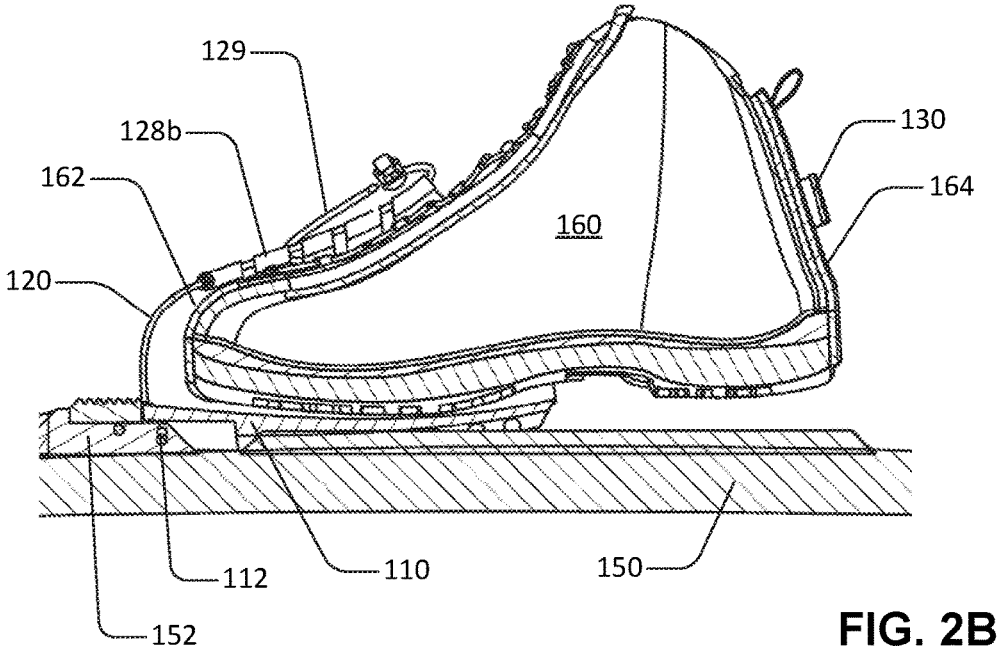
FIG. 2B

UNIVERSAL SHOE HARNESS FOR NORDIC SKI

BACKGROUND OF THE INVENTION

Field of the Invention

The present invention relates to ski equipment, and more particularly, to cross-country skiing and related footwear.

Related Art

Cross-country skiing (also known as Nordic skiing) is a fun winter sport activity that the whole family can enjoy. While cross-country skiing can be enjoyed on groomed trails, in the back country, or even in competitions, a common application is for a casual user to ski around their neighborhood during sporadic snow events, or at a winter get away with friends and family.

Cross-country skiing generally requires skis and ski boots with each ski including a particular binding system and the ski boots having compatible binding mechanism. In order to ski using the skis (having the particular binding system), the skier is required to have ski boots having a built-in binding mechanism that is designed to engage the specific binding system as well as having the correct size boot for the skier. There are many different ski binding systems, each biding system requiring its own binding mechanism type to be built into the ski boots.

Two common binding systems are, for example only, NNN (New Nordic Norm) binding system and SNS (Salomon Nordic System) system. Each binding system requires a matching binding mechanism built into the ski boot to engage. That is, ski boots having NNN type binding mechanism are not compatible with skis having SNS binding system, and ski boots having SNS type binding mechanism are not compatible with skis having NNN binding system. Further, skis having these or similar binding systems do not allow the skis to be used by skiers wearing non-ski shoes or boots, for example, hiking boots or snow boots.

For at least these reasons, it is difficult to share ski gear among friends and family. Each ski requires a ski boot having compatible binding mechanism, and each ski boot is made with a particular binding mechanism and in a particular size. In order to share skis, each person wishing to use the skis is required to have ski boots having a compatible binding mechanism and the correct size.

In friend and family gatherings, veteran cross-country skiers with skis (having a particular binding system such as, for example, the NNN or the SNS system) may wish to share his or her skis with novice or occasional skiers. However, the novice and the occasional skiers may not wish to invest in custom ski boots having a built in binding mechanism (that is compatible with the binding system of the skis).

Moreover, the novice and the occasional skiers and even the veteran skier may wish to ski using the skis (having one of the binding systems such as, for example, the NNN or the SNS binding system) while wearing non-ski shoes or boots such as, for example, hiking boots or snow boots.

It is possible to use non-ski shoes or boots for cross-country skiing using skis having cable binding systems (also referred to as Kandahar bindings or bear-trap bindings) or similar binding systems (collectively referred to as "cable binding systems"). However, cable binding systems present a number of drawbacks. Firstly, skis having cable binding systems are not commonly available in the sport. Secondly, veteran cross-country skiers are not likely to use or to keep skis having cable binding systems because the common binding systems with matching ski boots provide superior skiing experience compared to cable binding systems with non-ski shoes or boots.

Thirdly, the cable binding system is merely another permanently-installed binding system for a cross country ski. That is, a cable binding system replaces an existing binding system, but does not work in combination with any other binding systems. Lastly, cable binding systems cannot be used with ski boots having a common binding mechanism such as an NNN or an SNS compatible mechanism Accordingly, there remains a need for cross-country ski apparatus that allows for universal use and sharing of cross-country skis with built-in binding systems by multiple users, and use and sharing of cross-country skis by using non-ski shoes or boots of varying designs and sizes.

SUMMARY OF THE INVENTION

The need is met by the present invention. In one embodiment of the present invention, a ski shoe harness includes a sole, a receiver, and a heel strap. The sole includes a binding mechanism adapted to engage a ski binding system. The receiver is attached to the sole. Combined, the sole and the receiver define a space where the front portion of a shoe is inserted. Thus, the sole and the receiver are adapted to receive the front portion of the shoe. The heel strap is attached to the receiver. The heel strap wraps around the rear portion of the shoe, thusly securely interlocking, in combination with the sole and the receiver, the shoe with the ski shoe harness. Accordingly, using the ski shoe harness of the present invention, non-ski shoes or boots, of varying sizes, may be worn and use the ski to which the ski shoe harness is engaged.

The binding mechanism of the ski shoe harness may vary depending on the binding system attached to the ski. Presently, popular binding systems include, for example, NNN (New Nordic Norm), SNS (Salomon Nordic Systems), SNS Profil, SNS Pilot, NN (Nordic Norm), Turnamic, and 75 mm 3-Pin binding systems.

The receiver of the ski shoe harness includes a left receiver portion and a right receiver portion made of plastic, leather, rubber, or other pliable or non-pliable material. A receiver tightening element is used to bolster the security of the interlock between the shoe and the ski shoe harness. In one embodiment, the tightening element is a lace. For that embodiment, to accommodate the lace, the left and the right receiver portions include a plurality of lace stays with each lace stay defining a lace loop. Here, the lace is threaded through the lace loops to bolster the security of the interlock between the shoe and the ski shoe harness. Alternately, eye stays and eyelets may be used, allowing the lace to be threaded through the eyelets.

In another embodiment, the tightening element may include different elements such as, for example, a strap, a buckle, a clip, a hook-and-loop system, or any combination of these. For such embodiment, lace stays and lace loops are not needed. Rather, these alternate tightening elements may be attached to the left and the right portions of the receiver, and pulled together to bolster the security of the interlock between the shoe and the ski shoe harness.

The heel strap may be made of elastic or inelastic material depending on design and the desired characteristic of the ski shoe harness. Further, the heel strap may include an adjustment mechanism. The adjustment mechanism may be, for example only, a strap, a buckle, a clip, a lace, a hook-and-loop system, or any combination of these. The adjustment mechanism allows the ski shoe harness to interlock with shoes of varying designs and sizes.

In yet another embodiment of the present invention, a ski shoe harness includes a sole, left and right receiver panels, a tightening element, and a heel strap. The sole has a left side and a right side and includes a binding mechanism adapted to engage a ski binding system. The left receiver panel is attached to the left side of the sole. The right receiver panel is attached to the right side of the sole. The sole and the left receiver panel and the right receiver panel embody an open toe design.

The sole and the left and the right receiver panels, combined, define a space where the front portion of a shoe is inserted. The tightening element is connected to the left receiver panel and to the right receiver panel. The tightening element wraps around the top of the front portion of the shoe to secure, along with the heel strap, the interlock of the shoe with the ski shoe harness.

The heel strap is attached to the left receiver panel and to the right receiver panel. The heel strap wraps around the rear portion of the shoe to secure, along with the tightening element, the interlock of the shoe with the ski shoe harness.

The binding mechanism of the ski shoe harness may vary depending on the binding system attached to the ski. Presently, popular binding systems include, for example, NNN (New Nordic Norm), SNS (Salomon Nordic Systems), SNS Profil, SNS Pilot, NN (Nordic Norm), Turnamic, and 75 mm 3-Pin binding systems.

The tightening element is used to bolster the security of the interlock between the shoe and the ski shoe harness. In alternate embodiments, the tightening element may include different devices such as, for example, a lace, a strap, a buckle, a clip, a hook-and-loop system, or any combination of these.

The heel strap may be made of elastic or inelastic material depending on design and the desired characteristic of the ski shoe harness. Further, the heel strap may include an adjustment mechanism. The adjustment mechanism may be, for example only, a strap, a buckle, a clip, a lace, a hook-and-loop system, or any combination of these. The adjustment mechanism allows the ski shoe harness to interlock with shoes of varying designs and sizes.

Accordingly, the ski shoe harness of the present invention presents a solution to the shortcomings of the existing cross-country ski apparatus discussed herein above.

BRIEF DESCRIPTION OF THE DRAWINGS

FIG. 1A is a perspective view of a first example embodiment of the present invention;

FIG. 1B is a top view of the embodiment of the present invention illustrated by FIG. 1A;

FIG. 2A is a side view of the embodiment of the present invention illustrated by FIGS. 1A, 1B, and 1C, and additional elements illustrating the embodiment in use;

FIG. 2B is a cut-away side view of the embodiment of the present invention illustrated by FIG. 2A;

DESCRIPTION OF EXEMPLARY EMBODIMENTS

Figure 1C:
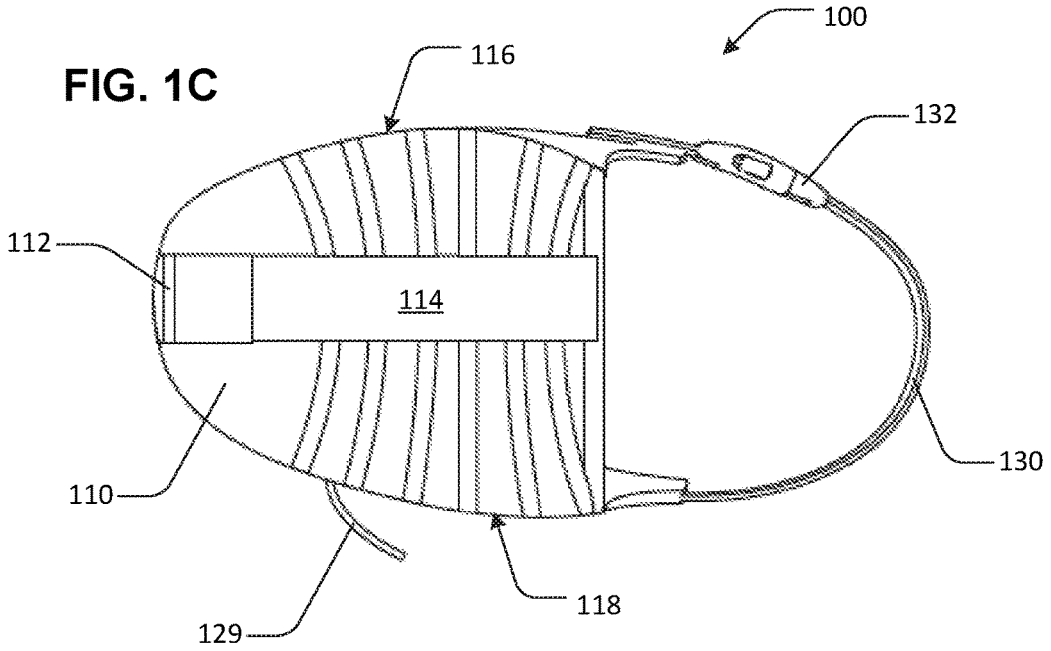
FIG. 1C is a bottom view of the embodiment of the present invention illustrated by FIGS. 1A and 1B.

In FIG. 1A, a perspective view of a ski shoe harness 100 of an example embodiment of the present invention is illustrated. FIG. 1B is a top view of the ski shoe harness 100 of FIG. 1A. FIG. 1C is a bottom view of the ski shoe harness 100 of FIG. 1A. In FIG. 2A, the ski shoe harness 100 is illustrated along with a portion of a ski 150 to which the ski shoe harness 100 is engaged to and along with a shoe 160 with which the ski shoe harness 100 is interlocked. In FIG. 2B, the ski shoe harness 100, the ski 150, and the shoe 160 are illustrated in a cut-away diagram.

In this document, term "shoe" includes any and all external covering for the human foot and footwear, including, without limitation, shoes, boots, specialty footwear, custom footwear, sports shoes, sports boots, and others. For example only, snow boots, hunting boots, and hiking shoes and boots.

Referring to FIGS. 1A, 1B, 1C, 2A, and 2B, the ski shoe harness 100 includes a sole 110, a receiver 120, and a heel strap 130. The sole 110 includes a binding mechanism 112 that is adapted to engage the ski 150 by engaging a binding system 152 attached to the ski 150. The sole 110 is made of substantially stiff material such as, for example only and without limitation, plastic, rubber, or similar composite material. In the illustrated embodiment the sole 110 has lateral length that is a fraction of the lateral length of the shoe 160. In other possible embodiments, the sole 110 may have lateral length that is equal to or exceed the lateral length of the shoe 160. Such design would remain within the scope of the present invention. Additionally, the sole 110 has a left side 116 and a right side 118. Reference numbers for the sides 116 and 118 of the sole 110 are illustrated in FIG. 1C only because these sides are most clearly visible from the bottom view of the present embodiment of the ski shoe harness 100. In the Figures, top views of the sole 110 (in FIGS. 1B, 3, and 4) are illustrated with regularly spaced parallel dashed hatching lines to show the extent of the sole. In these Figures, the horizontal dashed hatching lines of the top views of the sole 110 (in FIGS. 1B, 3, and 4) do not indicate a sectional or cross sectional view.

The binding mechanism 112 is adapted to engage with a binding system 152 to which the binding mechanism 112 is compatible. The binding systems to which the binding mechanism 112 is adapted to engage includes, for example, the following Nordic ski binding systems: NNN (New Nordic Norm), SNS (Salomon Nordic Systems), SNS Profil, SNS Pilot, NN (Nordic Norm), Turnamic, and 75 mm 3-Pin, or other existing binding systems. The binding systems to which the binding mechanism 112 is adapted to engage is not limited to the listed binding systems, but include other binding systems currently available or developed in the future. The ski shoe harness 100 including a binding mechanism adapted to engage these future binding systems are within the scope of the present invention.

In the illustrated example embodiment, the binding mechanism 112 is a metal bar or a toe bar adapted to engage a SNS Profil type binding system 152. For the present invention, the design (i.e. the shape and size) of the binding mechanism 112 may differ depending on the type of the binding system 152 for which the ski shoe harness 100 is adapted to engage. The sole 110 may also include an open channel 114 on its bottom side as needed for the NNN, SNS Profil, and Turnamic binding systems.

The receiver 120 has a general shape of a toe cap of a shoe or a boot and is attached to the sole 110. The receiver 120 and the sole 110, combined, are adapted to receive the front portion 162 of the shoe 160. The front portion 162 of the shoe 160 may include, for example, at least a portion of the shoe's toe, at least a portion of the shoe's toe box, at least a portion of the shoe's toe cap, at least a portion of the shoe's vamp, at least a portion of the shoe's sole, or any combination of these parts.

Further, the receiver 120 has a left receiver portion 122 and a right receiver portion 124. The left receiver portion 122 and a right receiver portion 124 are integral parts of the receiver 120. In the illustrated embodiment, these portions 122 and 124 are separated from each other; however, in alternate embodiments of the present invention, these the left and the right portions 122 and 124 may touch or even overlap each other. A receiver tightening element is used to bolster the security of the interlock between the shoe and the ski shoe harness 100. In the illustrated example, the receiver tightening element is a lace 129.

In the illustrated ski shoe harness 100, in order to use the lace 129 as the receiver tightening element, both the left receiver portion 122 and the right receiver portion 124 include a plurality of lace stays 126*a*, 126*b*. To avoid clutter and to more clearly describe the present invention, only two (of possibly many) lace stays 126*a* and 126*b* are assigned reference numbers in the drawings. Each lace stay 126*a* and 126*b* defines a lace loop. In the illustrated embodiment, lace stay 126*a* defines lace loop 128*a* and lace stay 126*b* defines lace loop 128*b*. Again, to avoid clutter and to more clearly describe the present invention, only two (of possibly many) lace loops 128*a* and 128*b* are assigned reference numbers in the drawings. The lace 129 is threaded through the lace loops 128*a* and 128*b* and tightened to securely interlock the shoe 160 with the ski shoe harness 100. Each lace loop 128*a* and 128*b* are adapted to receive a lace.

Figure 3:
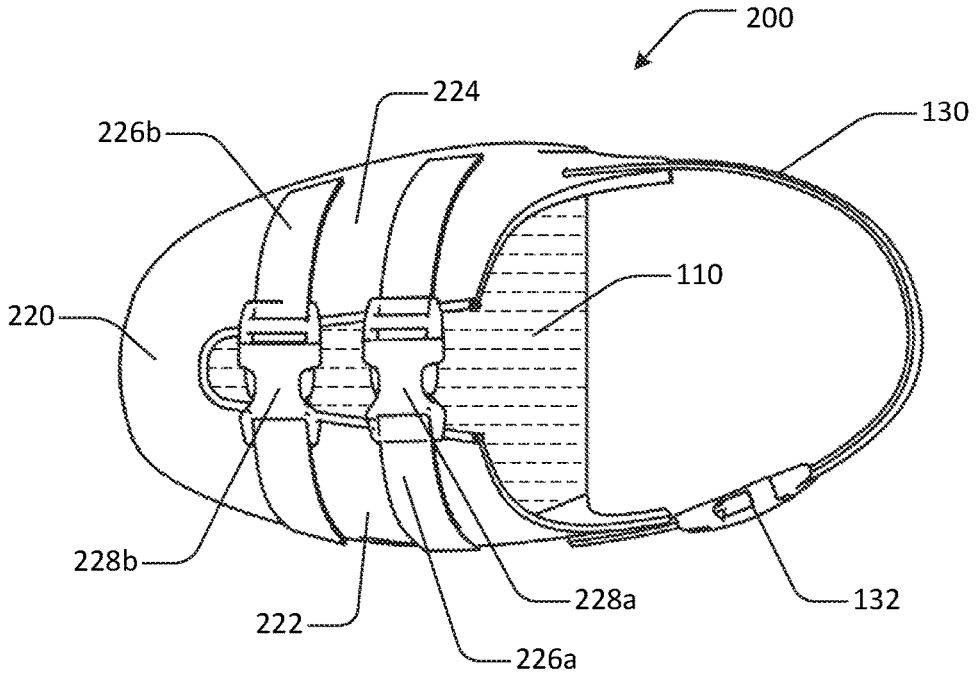
FIG. 3 is a top view of a second example embodiment of the present invention.

In an alternative embodiment, the lace stay 126*a* and 126*b* and the lace loops 128*a* and 128*b* may be implemented as eye stays and eyelets. In another alternative embodiment, the receiver tightening element may be implemented as a strap, a buckle, a clip, a lace, a hook-and-loop system, or any combination of these or other fastening or attachment system. In such implementation, the lace stays 126*a*, 126*b* and lace loops 128*a*, 128*b* may not be needed. One such example embodiment is illustrated in FIG. 3 and discussed herein below.

Continuing to refer to FIGS. 1A, 1B, 1C, 2A, and 2B, the heel strap 130 is attached to the receiver 120 to allow the heel strap 130 to wrap around the rear portion 164 of the shoe 160 such that the shoe 160 is securely interlocked with the ski shoe harness 100. The heel strap 130 may be an integrated portion of the receiver 120. In an alternative embodiment, the heel strap 130 may be a separate element that is detachably connected to the receiver 120. In such embodiment, the heel strap may be easily replaceable.

The rear portion 164 of the shoe 160 described above may include, for example, at least a portion of the shoe's heel, at least a portion of the shoe's heel counter, at least a portion of the shoe's heel cap, at least a portion of the shoe's back stay, at least a portion of the shoe's foxing, or any combination of these parts.

The heel strap 130 may be made of elastic material such as rubber or similar material or non-elastic material such as, without limitation, plastic or cloth. The heel strap 130 has a length measured from its point of attachment to the left receiver portion 122 to its point of attachment to the right receiver portion 124. Further, the heel strap may include a heel strap adjustment mechanism 132 used to securely adjust tightness of the interlocking fit between the ski shoe harness 100 and the shoe 160. The heel strap adjustment mechanism 132 is also adapted to adjust the length of the heel strap 120.

The heel strap adjustment mechanism 132 may include, for example, a buckle, a clip, a lace, a hook-and-loop system, or any combination of these. Use of an elastic heel strap, a heel strap adjustment mechanism, or both allows for adjustability of the size of the shoe 160 that can securely interlock with the ski shoe harness 100. That is, with the adjustable heel strap 130, skiers having a wide range of different shoe sizes can utilize the same ski 150. Additionally, shoes having different designs and styles may be worn while utilizing the ski 150. That is, with the present invention, the ski becomes available for use by people wearing non-ski shoes or boots such as, for example, hiking shoes or snow boots of varying designs, styles, shapes, and sizes.

In FIG. 3, a top view of a ski shoe harness 200 of another example embodiment of the present invention is illustrated. Referring to FIG. 3, the ski shoe harness 200 includes portions that are identical to or similar to corresponding portions of the ski shoe harness 100 of FIGS. 1A through 2B. For example, the ski shoe harness 200 includes a sole 110 and a heel strap 130 both of which are identical to or similar to the corresponding portions of the ski shoe harness 100 of FIGS. 1A through 2B.

However, some portions of the ski shoe harness 200 are similar to yet different than corresponding portions of the ski shoe harness 100 of FIGS. 1A through 2B. The ski shoe harness 200 includes a receiver 220 that is similar to yet different than the receiver 120 of the ski shoe harness 100 of FIGS. 1A through 2B. The receiver 220, similar to the ski shoe harness 100 of FIGS. 1A through 2B, has a general shape of a toe cap of a shoe or a boot and is attached to the sole 110. Also, the receiver 220 and the sole 110, combined, are adapted to receive the front portion of a shoe (similar to the interlocking relationship illustrated in FIGS. 2A and 2B with respect to the ski shoe harness 100 and the shoe 160).

Additionally, the receiver 220 (similar to the receiver 120 of the ski shoe harness 100 or FIGS. 1A through 2B) includes a left receiver portion 222 and a right receiver portion 224. For the ski shoe harness 200 (unlike the ski shoe harness 100 of FIGS. 1A through 2B) its tightening element includes straps 226*a*, 226*b* and buckles 228*a*, 228*b*. The straps 226*a*, 226*b*, and the buckles 228*a*, 228*b* are attached to the left receiver portion 222 and its right receiver portion 224.

Because the straps 226*a*, 226*b* and the buckles 228*a*, 228*b* are used as the receiver tightening element, the left and the right receiver portions 222 and 224 of the ski shoe harness 200 do not need lace stays 126*a* and 126*b* and lace loops 128*a* and 128*b* of the ski shoe harness 100 (of FIGS. 1A through 2B). Further, depending on various factors, the ski shoe harness 200 may include only one strap and one buckle or multiple straps and buckles.

Figure 4:
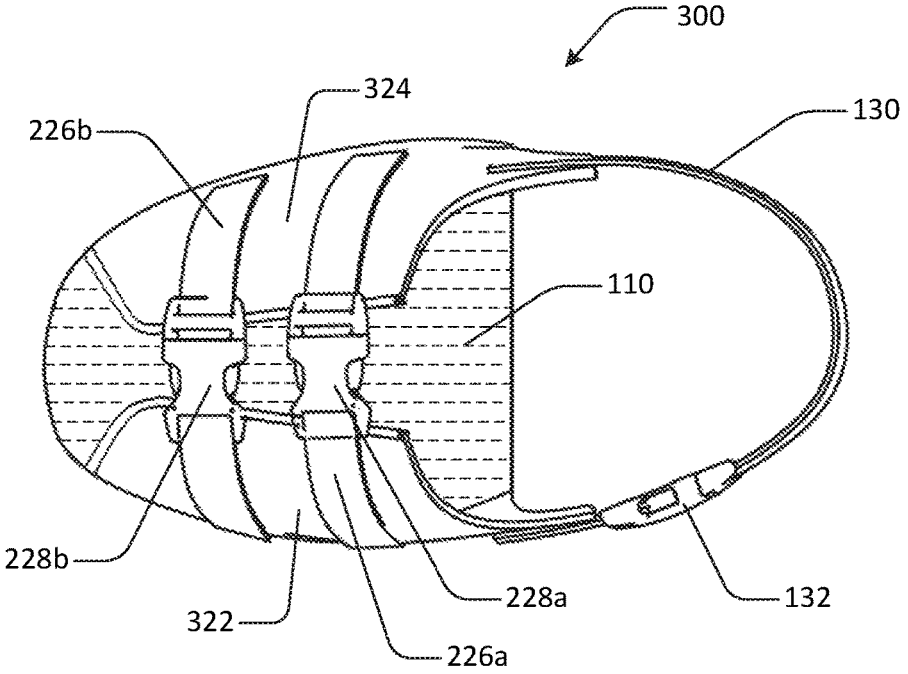
FIG. 4 is a top view of a third example embodiment of the present invention.

In FIG. 4, a top view of a ski shoe harness 300 of yet another example embodiment of the present invention is illustrated. Referring to FIG. 4, the ski shoe harness 300 includes portions that are identical to or similar to corresponding portions of the ski shoe harness 200 of FIG. 3. For example, the ski shoe harness 300 includes a sole 110 which is identical to or similar to the sole 110 of the ski shoe harness 200 of FIG. 3, which, in turn, is identical to or similar to the sole 110 of the ski shoe harness 100 of FIGS. 1A through 2B.

However, some portions of the ski shoe harness 300 are similar to yet different than corresponding portions of the ski shoe harness 200 of Figure. For example, The ski shoe harness 200 of FIG. 3 includes the receiver 220 having a general shape of a toe cap of a shoe or a boot and also having a left receiver portion 222 and a right receiver portion 224 (illustrated in FIG. 3). In contrast, the ski shoe harness 300 has an open toe configuration as illustrated in FIG. 4.

Continuing to refer to FIG. 4, the ski shoe harness 300 includes a left receiver panel 322 attached to the left side 116 (shown in FIG. 1C) of the sole 110 and a right receiver panel 324 attached to the right side 118 (shown in FIG. 1C) of the sole 110. Here, the left and right receiver panels 322 and 324, along with the sole 110, embody an open toe design as illustrated in the Figures.

In use, the front portion of a shoe is placed between the left and the right receiver panels 322 and 324 and on the sole 110. Straps 226*a*, 226*b* and buckles 228*a*, 228*b* form a tightening element of the ski shoe harness 300 that bolster the security of the interlock between the ski shoe harness 300 and the placed shoe. The straps 226*a*, 226*b* and the buckles 228*a*, 228*b* of the ski shoe harness 300 are similar to the corresponding straps 226*a*, 226*b* and buckles 228*a*, 228*b* of the ski shoe harness 200 (illustrated in FIG. 3). In alternative embodiments, the tightening element is selected from a group comprising a strap, a buckle, a clip, a lace, and a hook-and-loop system.

Further, similar to the ski shoe harness 200 (illustrated in FIG. 3), the ski shoe harness 300 also includes a heel strap 130 that wraps around the rear portion of the placed shoe. The heel strap 130 is attached to the left receiver panel 322 and to the right receiver panel 324. The heel strap 130 may include a heel strap adjustment mechanism 132 selected from a group comprising a strap, a buckle, a clip, a lace, and a hook-and-loop system. In the illustrated embodiment, the heel strap adjustment mechanism 132 is a buckle 132. The heel strap 130 may be detachably connected to the left and the right receiver panels 322 and 324.

The example embodiments depicted in the Figures and discussed herein drawings are not necessarily drawn to scale. Modifications, additions, or omissions may be made to the apparatuses illustrated and described herein without departing from the spirit of and scope of the invention. For example, the components of the apparatuses may be integrated or separated. Moreover, apparatuses illustrated and disclosed herein may be performed by more, fewer, or other components. The applicant does not intend any of the claims or claim elements to invoke 35 U.S.C. 112(f) unless the words "means for" or "step for" are explicitly used in the claim.

What is claimed is:

1. A shoe harness adapted to interlock a ski with a shoe having a front portion and a rear portion, the shoe harness comprising:

a sole, said sole comprising a binding mechanism adapted to engage a binding system of the ski;

a receiver attached to said sole wherein said sole and said receiver, in combination, adapted to receive the front portion of the shoe;

a heel strap attached to said receiver, said heel strap adapted to wrap around the rear portion of the shoe whereby the shoe securely interlocks with the shoe harness; and a tightening element adapted to tighten a left receiver portion of the receiver with a right receiver portion of the receiver.

2. The shoe harness recited in claim 1 wherein said binding mechanism is adapted to engage a binding system selected from a group comprising NNN, SNS, SNS Profil, SNS Pilot, Nordic Norm (NN), Turnamic, 75 mm 3-Pin binding systems.

3. The shoe harness recited in claim 1 wherein the receiver tightening element is a lace and wherein the left receiver portion and the right receiver portion comprises a plurality of lace stays and, each lace stay defining a lace loop adapted to receive the lace.

4. The shoe harness recited in claim 1 wherein the receiver tightening element is selected from a group comprising a strap, a buckle, a clip, a lace, and a hook-and-loop system.

5. The shoe harness recited in claim 1 wherein said heel strap comprises a heel strap adjustment mechanism.

6. The shoe harness recited in claim 5 wherein said heel strap adjustment mechanism is selected from a group comprising a strap, a buckle, a clip, a lace, and a hook-and-loop system.

7. The shoe harness recited in claim 1 wherein said heel strap comprises elastic material.

8. The shoe harness recited in claim 1 wherein said heel strap is detachably connected to said receiver.

9. A shoe harness adapted to interlock a ski with a shoe having a front portion and a rear portion, the shoe harness comprising:

a sole, said sole comprising a binding mechanism adapted to engage a binding system of the ski;

a receiver attached to said sole wherein said sole and said receiver, in combination, adapted to receive the front portion of the shoe;

a tightening element connected to said receiver, said tightening element adapted to tighten a left portion of said receiver with a right portion of said receiver;

a heel strap attached to said receiver, said heel strap having a defined length, and said heel strap adapted to wrap around the rear portion of the shoe, whereby the shoe securely interlocks with the shoe harness; and wherein said heel strap comprising a heel strap adjustment mechanism adapted to adjust the length of said heel strap.

10. The shoe harness recited in claim 9 wherein said binding system selected from a group comprising NNN, SNS, SNS Profil, SNS Pilot, Nordic Norm (NN), Turnamic, and 75 mm 3-Pin binding systems.

11. The shoe harness recited in claim 9 wherein said tightening element is selected from a group comprising a strap, a buckle, a clip, a lace, and a hook-and-loop system.

12. The shoe harness recited in claim 9 wherein said heel strap adjustment mechanism is selected from a group comprising a strap, a buckle, a clip, a lace, and a hook-and-loop system.

13. A shoe harness comprising:

a sole, said sole comprising a binding mechanism adapted to engage a binding system of a ski, said sole having a left side and a right side;

a left receiver panel attached to the left side of said sole;

a right receiver panel attached to the right side of said sole;

a tightening element connected to said left receiver panel and to said right receiver panel, wherein said tightening element is selected from a group comprising a strap, a buckle, a clip, a lace, and a hook-and-loop system; and a heel strap attached to said left receiver panel and to said right receiver panel.

14. The shoe harness recited in claim 13 wherein said binding mechanism is adapted to engage a binding system selected from a group comprising NNN, SNS, SNS Profil, SNS Pilot, Nordic Norm (NN), Turnamic, 75 mm 3-Pin binding systems.

15. The shoe harness recited in claim 13 wherein said heel strap comprises a heel strap adjustment mechanism selected from a group comprising a strap, a buckle, a clip, a lace, and a hook-and-loop system.

16. The shoe harness recited in claim 13 wherein said heel strap is detachably connected to said left receiver panel and to said right receiver panel.

* * * * *